US011415905B2

(12) United States Patent
Nishida et al.

(10) Patent No.: US 11,415,905 B2
(45) Date of Patent: Aug. 16, 2022

(54) IMAGE FORMING APPARATUS

(71) Applicant: Konica Minolta, Inc., Tokyo (JP)

(72) Inventors: Satoshi Nishida, Saitama (JP); Nobuhiko Okano, Hino (JP); Hiroshi Yamaguchi, Toyokawa (JP); Yujiro Ishida, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/335,318

(22) Filed: Jun. 1, 2021

(65) Prior Publication Data

US 2021/0382407 A1 Dec. 9, 2021

(30) Foreign Application Priority Data

Jun. 4, 2020 (JP) ..... JP2020-097753

(51) Int. Cl.
*G03G 15/01* (2006.01)
*G03G 15/16* (2006.01)

(52) U.S. Cl.
CPC ..... *G03G 15/0189* (2013.01); *G03G 15/0173* (2013.01); *G03G 15/161* (2013.01)

(58) Field of Classification Search
CPC ..... G03G 15/1615; G03G 15/5008; G03G 15/161; G03G 15/167; G03G 15/0136; G03G 2215/0193
See application file for complete search history.

(56) References Cited

U.S. PATENT DOCUMENTS

2011/0129241 A1* 6/2011 Tomioka ..... G03G 15/1615 399/36
2011/0293307 A1* 12/2011 Ogata ..... G03G 15/161 399/121
2013/0084086 A1* 4/2013 Ikeda ..... G03G 15/167 399/36
2017/0308012 A1* 10/2017 Kibayashi ..... G03G 15/652

FOREIGN PATENT DOCUMENTS

JP 2008304552 A 12/2008
JP 5585770 B2 9/2014

* cited by examiner

*Primary Examiner* — Jessica L Eley

(74) *Attorney, Agent, or Firm* — Osha Bergman Watanabe & Burton LLP

(57) ABSTRACT

An image forming apparatus includes: a first rotatable member; a second rotatable member that presses against the first rotatable member in a pressed state and separates from the first rotatable member in a separated state; and a hardware processor that sets a target speed of the second rotatable member based on a change in speed of the second rotatable member between a first speed in the separated state and a second speed in the pressed state.

10 Claims, 7 Drawing Sheets

IMAGE FORMING APPARATUS

CROSS-REFERENCE TO RELATED APPLICATIONS

The entire disclosure of Japanese Patent Application No. 2020-097753 filed on Jun. 4, 2020 is incorporated herein by reference in its entirety.

BACKGROUND

Technical Field

The present disclosure relates to an image forming apparatus.

Description of Related Art

Image forming apparatuses having multiple functions, such as a printer, facsimile, and copier, have been widely used. Such an image forming apparatus forms a latent image on a photoconductor on the basis of image data, develops the latent image using a developer, and transfers the developed image onto a sheet of paper directly or via an intermediate transfer belt. In transferring the image, a transfer member consisting of a transfer roller and/or a transfer belt is pressed against an image carrier consisting of a photoconductor and/or an intermediate transfer belt, and the sheet is inserted into the pressed part (transfer nip part), so that the toner image is transferred onto the sheet.

The transfer member can be made to rotate by being pressed against the image carrier that is being driven to rotate. The transfer member, however, may not rotate properly when receiving a load. In such a case, the transfer member may require a transfer-member driver that drives the transfer member to rotate. Assume that an image forming apparatus includes a cleaning unit that removes toner images adhering to the transfer member. When the blade of the cleaning unit is pressed against the surface of the transfer member (e.g., transfer roller or transfer belt), the transfer member receives loads. To deal with this, such an image forming apparatus is provided with a transfer-member driver to drive the transfer member.

When the image carrier and the transfer member are individually driven to rotate, the rotation of the transfer member needs to be controlled so as not to affect the rotation of the image carrier and to avoid decrease in accuracy of image formation.

According to JP2008-304552A, for example, the driving force to be applied to the transfer member is regulated according to the usage history of the cleaning member and/or humidity in the air so as to reduce fluctuations of loads placed on the image carrier by the rotating transfer member. In JP2008-304552A, the driving system of the transfer member includes a torque limiter. A limiter value is set to be the load (mainly by the cleaning member) on the transfer member+$\alpha$. The transfer member is set to rotate slightly faster than the image carrier and, when being pressed against the image carrier, is made to slightly push the image carrier by +$\alpha$ torque within a value range of not being inversed by periodical fluctuations of speed. The torque limiter is operated under such circumstances, so that the torque applied to the image carrier is kept constant regardless of the presence of paper on the transfer member.

However, when a sheet of paper is inserted between the image carrier (herein, intermediate transfer belt) and the transfer member that are pressed against each other and driven to rotate, the diameter of rotation of the transfer member changes by the thickness of the sheet. When the transfer member is controlled to rotate at a constant speed, the torque applied to the image carrier changes on a cycle of passing sheets. Accordingly, the speed of the image carrier changes. This may cause color shifts in formed images (decrease color-register function), for example and eventually decrease accuracy of image formation. Further, according to the method of using the torque limiter, the limiter value may not be set when the load on the transfer member, which is mainly due to the cleaning member, greatly changes over time or due to the environment.

To deal with changes in torque of the transfer member or other members, JP5585770B discloses an image forming apparatus that performs constant-speed control of the transfer member and the image carrier when they are separate using feedback and that performs constant-torque control of the transfer member when the transfer member is pressed against the image carrier. Under the constant-speed control, the transfer member and the image carrier are rotated at a constant speed. Under the constant-torque control, the transfer member is controlled according to a driving torque detected during the constant-speed control, when the transfer member is separate from the image carrier.

However, the image carrier and the transfer member may have different surface speeds owing to, for example, variation in the outer diameters of the driving rollers thereof or variation in the thicknesses of the image carrier and the transfer member. The difference in surface speeds of the image carrier and the transfer member has not been solved by the known art and has caused a shear in transferred images. Variation in parts of an image forming apparatus results in difference in surface speeds of rotating two members pressed against each other, which eventually decreases image quality. Such a decrease in image quality can occur with (i) a photoconductor and a transfer body, (ii) a photoconductor and an intermediate transfer belt, (iii) an intermediate transfer belt and a second transfer member, and (iv) an upper fixing member and a lower fixing member, as well as the image carrier and the transfer member.

SUMMARY

One or more embodiments of the present invention restrain decrease in product quality of an image forming apparatus by reducing difference in surface speeds of two rotatable members that are pressed against each other.

According to one or more embodiments of the present invention, there is provided an image forming apparatus including: a first rotatable member; a second rotatable member that is configured to be pressed against and separated from the first rotatable member; and a hardware processor that sets a target speed of the second rotatable member based on a change in speed of the second rotatable member between a separated stated and a pressed state, the separated stated being a state in which the second rotatable member is separated from the first rotatable member, the pressed state being a state in which the second rotatable member is pressed against the first rotatable member.

BRIEF DESCRIPTION OF THE DRAWINGS

The advantages and features provided by one or more embodiments of the present invention will become more fully understood from the detailed description given hereinbelow and the appended drawings which are given by way of illustration only, and thus are not intended as a definition of the limits of the present invention, wherein.

DETAILED DESCRIPTION OF THE EMBODIMENTS

Hereinafter, an image forming apparatus of one or more embodiments of the present invention is described with reference to the drawings. In the embodiments of the present invention, a color image forming apparatus is described as an example but not intended to limit the scope of the invention. The present invention is also applicable to a monochrome image forming apparatus.

First Embodiment

[Configuration of Image Forming Apparatus]

Figure 1:
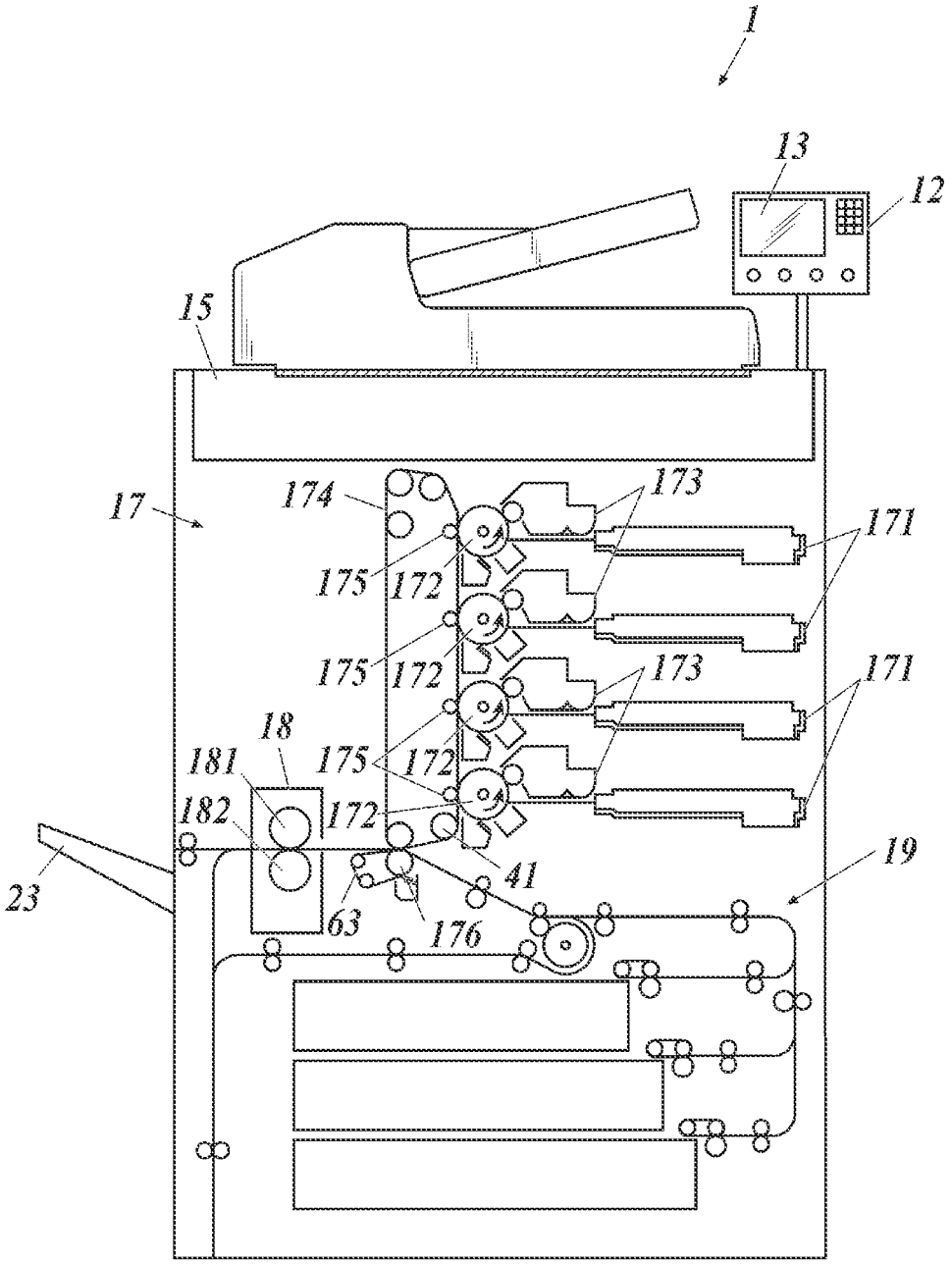
FIG. 1 is a schematic configuration of an image forming apparatus in a first embodiment of the present invention.
Figure 2:
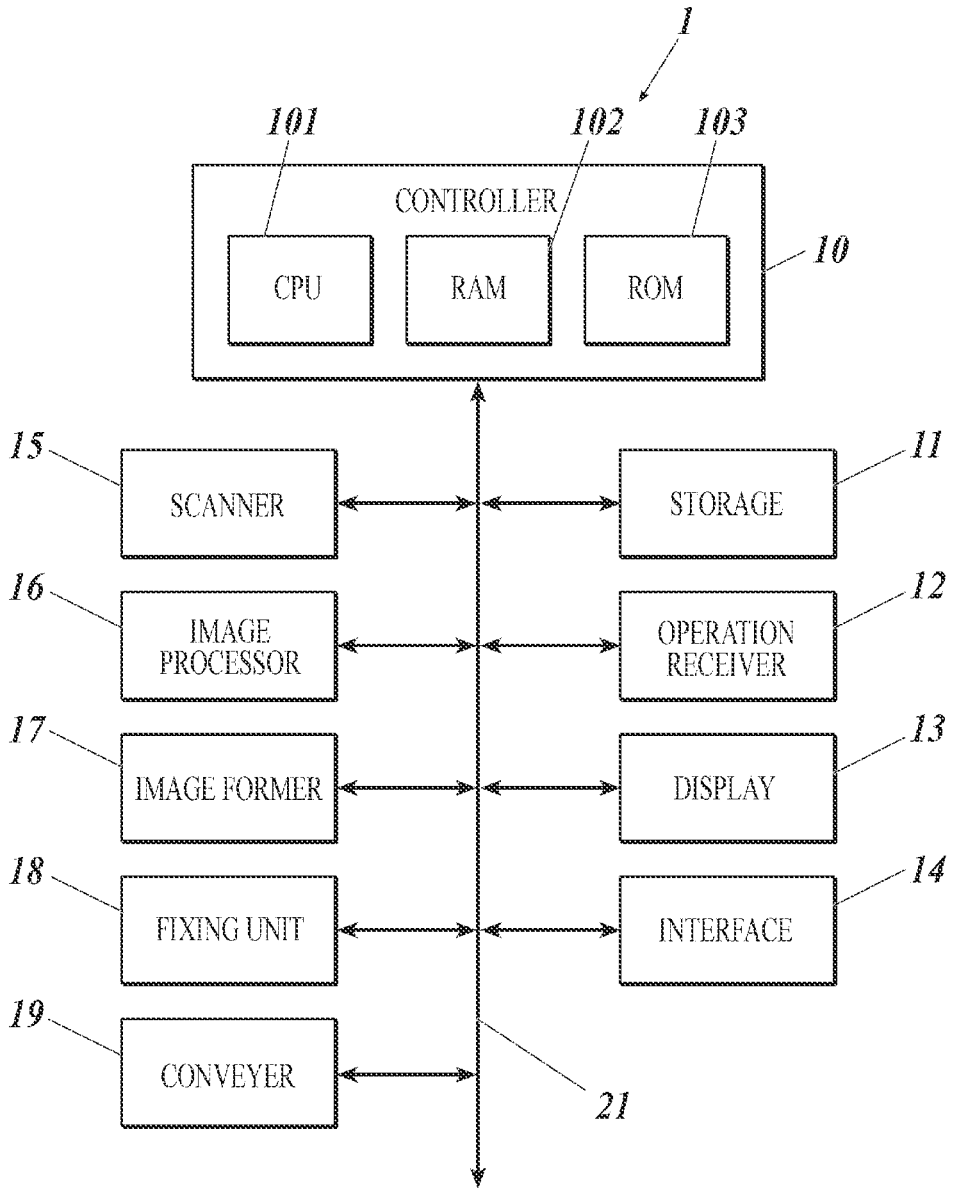
FIG. 2 is a block diagram showing main functional components of the image forming apparatus.

FIG. 1 is a schematic configuration of an image forming apparatus 1 in a first embodiment of the present invention. FIG. 2 is a block diagram showing main functional components of the image forming apparatus 1.

The image forming apparatus 1 includes: a controller 10 (hardware processor) that includes a central processing unit (CPU) 101, a random access memory (RAM) 102, and a read only memory (ROM) 103; a storage 11; an operation receiver 12; a display 13; an interface 14; a scanner 15; an image processor 16; an image former 17; a fixing unit 18; and a conveyer 19.

The controller 10 is connected to the storage 11, operation receiver 12, display 13, interface 14, scanner 15, image processor 16, image former 17, fixing unit 18; and conveyer 19 via a bus 21.

The CPU 101 reads and executes control programs stored in the ROM 103 or the storage 11 to perform various arithmetic processes.

The RAM 102 provides a working memory space for the CPU 101 and stores temporal data.

The ROM 103 stores various control programs to be executed by the CPU 101, setting data, and so forth. Instead of the ROM 103, a rewritable nonvolatile memory can be used, such as an electrically erasable programmable read only memory (EEPROM) and a flash memory.

The controller 10, which includes the CPU 101, the RAM 102, and the ROM 103, controls the components of the image forming apparatus 1 in accordance with the various control programs. For example, the controller 10 causes the image processor 16 to perform predetermined image processing on image data and causes the storage 11 to store the image data. The controller 10 also causes the conveyer 19 to convey sheets of paper and causes the image former 17 to form images on the sheets on the basis of the image data stored in the storage 11.

The storage 11 consists of, for example, a dynamic random access memory (DRAM) as a semiconductor memory and/or a hard disk drive (HDD). The storage 11 stores image data obtained by the scanner 15, image data input from outside via the interface 14, and various kinds of setting information. These kinds of data may be stored in the RAM 102.

The operation receiver 12 includes an input device, such as operation keys and a touchscreen superposed on the display screen of the display 13. The operation receiver 12 converts operations input with these input devices into operation signals and outputs the signals to the controller 10.

The display 13 includes, for example, a liquid crystal display (LCD) and displays various operation windows showing conditions of the image forming apparatus 1, contents of input operations on the touchscreen, and so forth.

The interface 14 performs data exchange with external computers and other image forming apparatuses and consists of, for example, any of various types of serial interfaces.

The scanner 15 reads images formed on the sheet, generates image data including single-color image data in respective color components of R (red), G (green), and B (blue), and stores the generated image data in the storage 11.

The image processor 16 includes a rasterization processing part, a color converting part, a tone correcting part, and a halftone processing part, for example. The image processor 16 performs various kinds of image processing on the image data stored in the storage 11 and stores the processed image data in the storage 11.

The image former 17 forms images on sheets of paper on the basis of the image data stored in the storage 11. The image former 17 includes four sets of an exposing unit 171, a photoconductor 172, and a developing unit 173 for the four color components of C (cyan), M (magenta), Y (yellow), and K (black). The image former 17 also includes an intermediate transfer belt (intermediate transfer body) 174 as an image carrier, a first transfer roller 175, and a second transfer roller 176.

The exposing unit 171 includes a laser diode (LD) as a light-emitting element. The exposing unit 171 drives the LD on the basis of the image data and irradiates/exposes the charged photoconductor 172 with/to a laser light, thereby forming an electrostatic latent image on the photoconductor 172. The developing unit 173 develops the electrostatic latent image formed on the photoconductor 172 by supplying, using the charged developing roller, toner (coloring material) in C, M, Y or K color onto the exposed photoconductor 172.

Images (single-color images) formed with C, M, Y, and K colors on the four corresponding photoconductors 172 are sequentially transferred from the photoconductors 172 onto the intermediate transfer belt 174 so as to be superposed on one another.

The intermediate transfer belt 174 (first rotatable member) is a semi-conducting endless belt. The intermediate transfer belt 174 is stretched around rollers including an intermediate-transfer driving roller 41 and rotatably supported by these rollers to be a loop. The intermediate transfer belt 174 is driven to rotate as the rollers rotate. The intermediate transfer belt 174 rotates according to the rotation of the rollers when toner images are transferred.

The intermediate transfer belt 174 is pressed against the photoconductors 172 by first transfer rollers 175 each facing the corresponding photoconductor 172. The first transfer rollers 175 receive voltage to flow the corresponding transfer current. Accordingly, the toner images formed on the surfaces of the photoconductors 172 are sequentially transferred (first transfer) onto the intermediate transfer belt 174 by the first transfer rollers 175.

The second transfer roller 176 rotates while being pressed against the intermediate transfer belt 174 with the second transfer belt 63 inbetween, so that the YMCK toner image transferred and formed on the intermediate transfer belt 174 is transferred (second transfer) onto the sheet conveyed from a sheet feeder. Residual toner on the intermediate transfer belt 174 is removed by a not-illustrated cleaning unit.

The detailed configuration of the intermediate transfer belt 174, the second transfer belt 176 (second transfer belt 63), and their surroundings is described later.

The fixing unit 18 includes an upper fixing member 181 with a heater and a lower fixing member 182. The fixing unit 18 heats and pressurizes the sheet on which toner has been transferred, so that the toner is fixed to the sheet.

The lower fixing member 182 is supplied with force towards the upper fixing member 181 by a not-illustrated elastic member. The upper fixing member 181 and the lower fixing member 182 rotate while the lower fixing member 182 is pressed against the upper fixing member 181, so that a nip part is formed to hold and convey the sheet.

The upper fixing member 181 may be constituted of a roller with a heater and a not-illustrated fixing belt stretched around the outer circumferential surface of the roller.

The conveyer 19 includes sheet conveying rollers that convey the sheet by rotating while holding the sheet, as shown in FIG. 1. The conveyer 19 conveys the sheet along a predetermined conveying path.

Hereinafter, the configuration of the intermediate transfer belt 174, the second transfer belt 63, and their surroundings is described in detail.

Figure 3A:
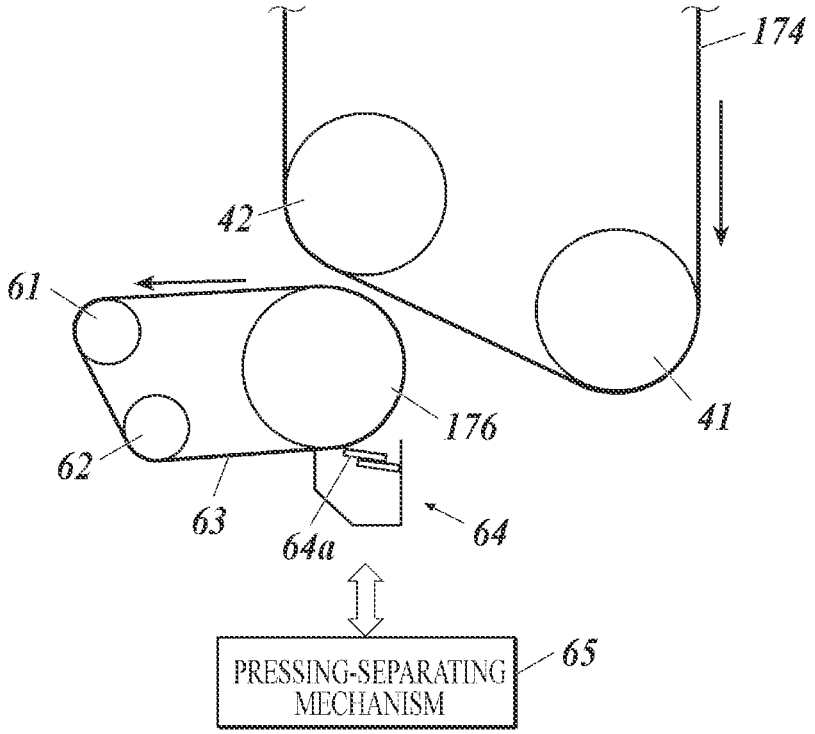
FIGS. 3A and 3B show a configuration of an intermediate transfer belt, a second transfer belt, and their surroundings.
Figure 3B:
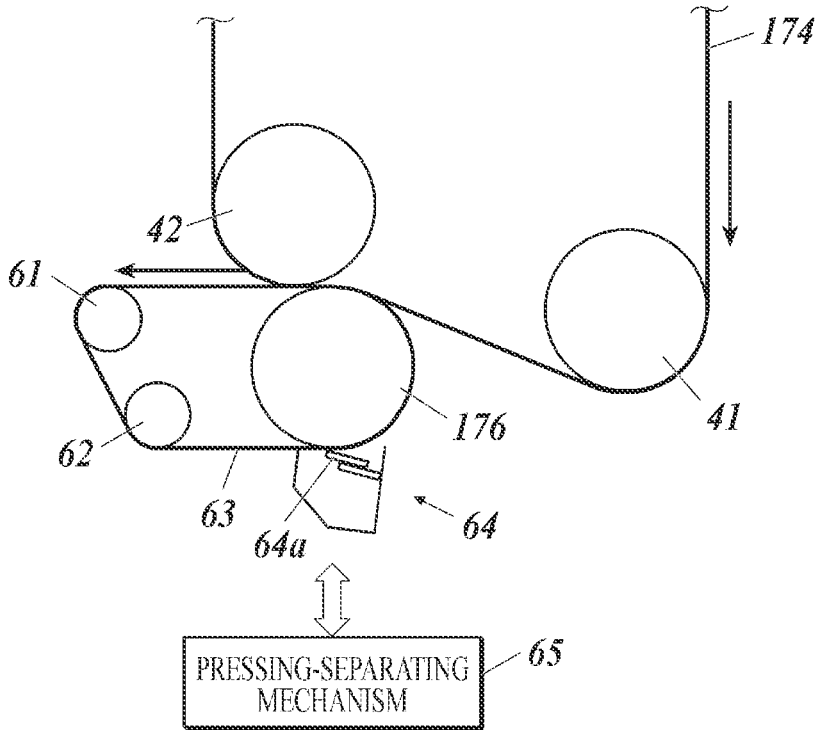

FIGS. 3A, 3B show how the intermediate transfer belt 174, the second transfer belt 63, and their surroundings are configured in the image forming apparatus 1.

As shown in FIGS. 3A, 3B, the intermediate transfer belt 174 is stretched around the intermediate-transfer driving roller 41, the intermediate-transfer driven roller 42, and other rollers.

The second transfer roller 176 is placed close to the intermediate transfer belt 174. A second transfer belt 63 as a second transfer member (second rotatable member) is stretched around the second transfer roller 176, a second-transfer driving roller 61, and a second-transfer driven roller 62. A cleaning blade 64*a* of a second-transfer cleaning unit 64 abuts the second transfer belt 63 to clean the surface of the second transfer belt 63.

A pressing-separating mechanism 65 moves the second transfer roller 176, the second-transfer driving roller 61, the second-transfer driven roller 62, the second transfer belt 63, and the second-transfer cleaning unit 64 altogether such that the second transfer belt 63 (second transfer roller 176) is pressed against or separated from the intermediate transfer belt 174. The pressing-separating mechanism 65 may have a known configuration and is not specifically limited to a specific configuration in one or more embodiments of the present invention.

FIG. 3A shows a separated state where the second transfer belt 63 (second transfer roller 176) is separate from the intermediate transfer belt 174. FIG. 3B shows a pressed state where the second transfer belt 63 (second transfer roller 176) is pressed against the intermediate transfer belt 174.

Figure 4:
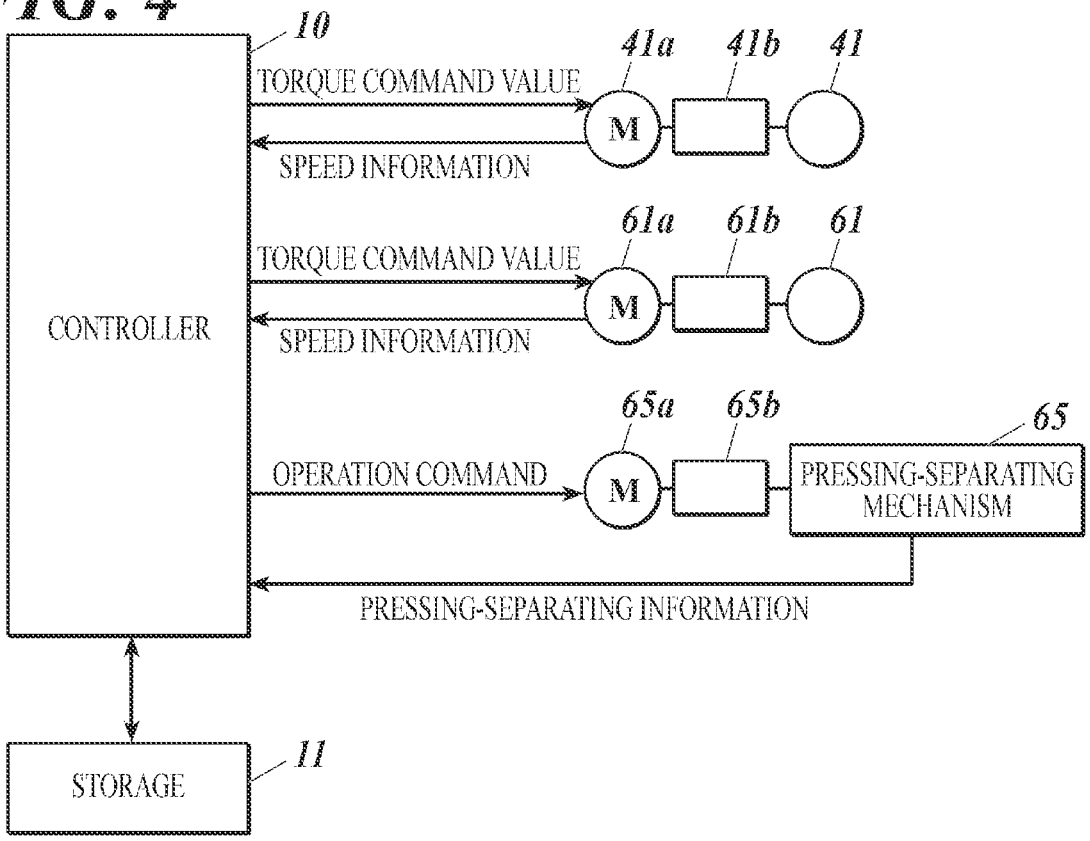
FIG. 4 is a circuit block diagram for controlling the intermediate transfer belt and the second transfer belt.

FIG. 4 is a block diagram of circuits for controlling the intermediate transfer belt 174 and the second transfer belt 63 in the image forming apparatus 1.

The controller 10 controls driving motors that drive the intermediate transfer belt 174, the second transfer belt 63, and the pressing-separating mechanism 65.

As shown in FIG. 4, an intermediate-transfer driving motor 41*a* is controllably connected to the controller 10. The intermediate-transfer driving motor 41*a* drives the intermediate-transfer driving roller 41 to rotate, so that the intermediate-transfer driving roller 41 rotates the intermediate transfer belt 174. The driving shaft of the intermediate-transfer driving motor 41*a* is connected to the intermediate-transfer driving roller 41 via an intermediate-transfer-drive transmitter 41*b*.

The intermediate-transfer driving motor 41*a* consists of a brushless DC motor. The controller 10 sends pulse width modulation (PWM) signals to the intermediate-transfer driving motor 41*a*. The PWM signals are sent as torque command values for controlling the speed and torque of the intermediate-transfer driving motor 41*a*. In accordance with the torque command values sent from the controller 10, the intermediate-transfer driving motor 41*a* is driven to rotate the intermediate-transfer driving roller 41.

The intermediate-transfer driving motor 41*a* is provided with a not-shown rotation sensor. The rotation sensor detects the rotation rate of the intermediate-transfer driving motor 41*a* (number of rotations per unit time, namely rotation speed) and gives feedback detection result to the controller 10 as speed information of the intermediate transfer belt 174. In one or more embodiments of the present invention, the rotation sensor may employ a known technology, such as a hall element, and is not limited to a specific sensor.

A second-transfer driving motor 61*a* is controllably connected to the controller 10. The second-transfer driving motor 61*a* drives the second-transfer driving roller 61 to rotate, so that the second-transfer driving roller 61 rotates the second transfer belt 63. The driving shaft of the second-transfer driving motor 61*a* is connected to the second-transfer driving roller 61 via a second-transfer-drive transmitter 61*b*.

The second-transfer driving motor 61*a* consists of a brushless DC motor. The controller 10 sends PWM signals to the second-transfer driving motor 61*a*. The PWM signals are sent as torque command values for controlling the speed and torque of the second-transfer driving motor 61*a*. In accordance with the torque command values sent from the controller 10, the second-transfer driving motor 61*a* drives the second-transfer driving roller 61 to rotate the second transfer belt 63.

The second-transfer driving motor 61*a* is provided with a not-shown rotation sensor. The rotation sensor detects the rotation rate of the second-transfer driving motor 61*a* (number of rotations per unit time, namely rotation speed) and gives feedback detection result to the controller 10 as speed information of the second transfer belt 63. The rotation sensor may employ a known technology, such as a hall element, and is not limited to a specific sensor in one or more embodiments of the present invention.

A pressing-separating motor 65*a* is controllably connected to the controller 10. The driving shaft of the pressing-separating motor 65*a* is connected to the pressing-separating mechanism 65 via a pressing-separating transmitter 65*b*. The pressing-separating motor 65*a*, the pressing-separating transmitter 65*b*, and the pressing-separating mechanism 65 move the second transfer belt 63 such that the second transfer belt 63 is pressed against or separated from the intermediate transfer belt 174.

The pressing-separating mechanism 65 is provided with a position sensor that detects the position of the second transfer roller 176 and so forth. The position sensor detects the position of the second transfer roller 176 and sends the detection result as pressing-separating information to the controller 10.

The controller 10 sends operation command values to the pressing-separating motor 65*a*. The operation command values are for controlling pressing-separating operation performed by the pressing-separating mechanism 65.

Next, operation performed by the controller 10 to control the intermediate transfer belt 174 and the second transfer belt 63 is described.

The controller 10 rotates the intermediate transfer belt 174 at a predetermined constant speed (target speed) according to image forming operation of the image forming apparatus 1. To achieve the target speed of the intermediate transfer belt 174, the controller 10 rotates the intermediate-transfer driving roller 41 at a constant speed by sending torque command values, which are PWM signals, to the intermediate-transfer driving motor 41*a*. Information on the PWM signals that yield the target speed is stored in the storage 11 beforehand. The controller 10 reads the information in the storage 11 to generate the PWM signals.

The rotation sensor (not shown) detects the rotation rate of the intermediate-transfer driving motor 41*a* and gives feedback detection result to the controller 10 as speed information of the intermediate transfer belt 174. The controller 10 determines whether or not the feedback speed information is within a set range. When determining that the speed information is within the set range, the controller 10 keeps the torque command values. When determining that the speed information is lower than the set range, the controller 10 generates PWM signals that correspond to increased torque command values. When determining that the speed information is higher than the set range, the controller 10 generates PWM signals that correspond to decreased torque command values. With the generated PWM signals, the controller 10 controls and drives the intermediate-transfer driving motor 41*a* to rotate at a speed within the set range. Accordingly, the intermediate transfer belt 174 is controlled to rotate at a constant speed (constant-speed control).

The controller 10 controls the rotation of the second transfer belt 63 differently depending on whether the second transfer belt 63 is pressed against the intermediate transfer belt 174 or separated from the intermediate transfer belt 174.

When determining that the second transfer belt 63 is separated from the intermediate transfer belt 174 (separated state), the controller 10 rotates the second transfer belt 63 at a predetermined constant speed (target speed). More specifically, the controller 10 rotates the second-transfer driving roller 61 at a constant speed by sending, to the second-transfer driving motor 61*a*, torque command values consisting of PWM signals that yield the target speed. Information on the PWM signals that yield the target speed is stored in the storage 11 beforehand. The controller 10 reads the information in the storage 11 to generate the PWM signals.

The controller 10 determines whether the second transfer belt 63 is pressed against or separated from the intermediate transfer belt 174 by using the position sensor. The position sensor detects the position of the second transfer belt 63 and/or the positions of members that move together with the second transfer belt 63 in pressing/separating operation, such as the second transfer roller 176. On the basis of the result of detection by the position sensor, the controller 10 determines whether the second transfer belt 63 is in the separated state or the pressed state.

The rotation of the second-transfer driving motor 61*a* is detected by the not-illustrated rotation sensor. The rotation sensor gives feedback detection result to the controller 10 as speed information of the second transfer belt 63. The controller 10 determines whether or not the feedback speed information is within a set range. When determining that the speed information is within the set range, the controller 10 keeps the torque command values. When determining that the speed information is lower than the set range, the controller 10 generates PWM signals that correspond to increased torque command values. When determining that the speed information is higher than the set range, the controller 10 generates PWM signals that correspond to decreased torque command values. With the generated PWM values, the controller 10 controls the second-transfer driving motor 61*a* to rotate at a speed within the set range. Accordingly, the second transfer belt 63 is controlled to rotate at a constant speed (constant-speed control).

Under the constant-speed control of the second transfer belt 63, the driving torque of the second-transfer driving motor 61*a* is detected as constant-speed driving torque. The driving torque of the second-transfer driving motor 61*a* may be detected by connecting a torque detector to the second-transfer driving motor 61*a* and obtaining detection results of the torque detector. Examples of the torque detector include a detector that is provided between the second-transfer driving motor 61*a* and the second-transfer driving roller 61 and that detects the driving torque on the basis of the amount of torsion therebetween. When the controller 10 uses PWM signals as described above, the controller 10 can analyze PWM signals, which serve as torque command values, to detect the driving torque in the constant-speed control. In detecting the constant-speed driving torque, a value with small deviation may be chosen, such as an average of torque values detected during a certain period of time. The period of time for detecting the constant-speed driving torque may be set to any period during which the torque is detectable. It is not necessary to detect the driving torque throughout the period during which the torque is detectable.

The above is the case of controlling the intermediate transfer belt 174 and the second transfer belt 63 in the separated state. Hereinafter, a case of controlling the intermediate transfer belt 174 and the second transfer belt 63 in the pressed state is described.

When the second transfer belt 63 is pressed against the intermediate transfer belt 174, the controller 10 performs constant-torque control under which the second-transfer driving motor 61*a* is controlled at a predetermined level of driving torque. The controller 10 performs the constant-torque control in accordance with the constant-speed driving torque of the second-transfer driving motor 61*a* detected under the constant-speed control of the second transfer belt 63. In performing the constant-torque control, the controller 10 generates PWM signals that correspond to the constant-speed driving torque on the basis of the relation between PWM signals and torque command values, and drives the second-transfer driving motor 61*a* with the generated PWM signals. Under the constant-torque control, the second-transfer driving motor 61*a* is controlled at a constant level of torque even when a sheet of paper is inserted between the second transfer belt 63 and the intermediate transfer belt 174 that abut each other. Accordingly, the second transfer belt 63 does not change the torque of the intermediate transfer belt 174, which enables proper image formation.

Figure 5:
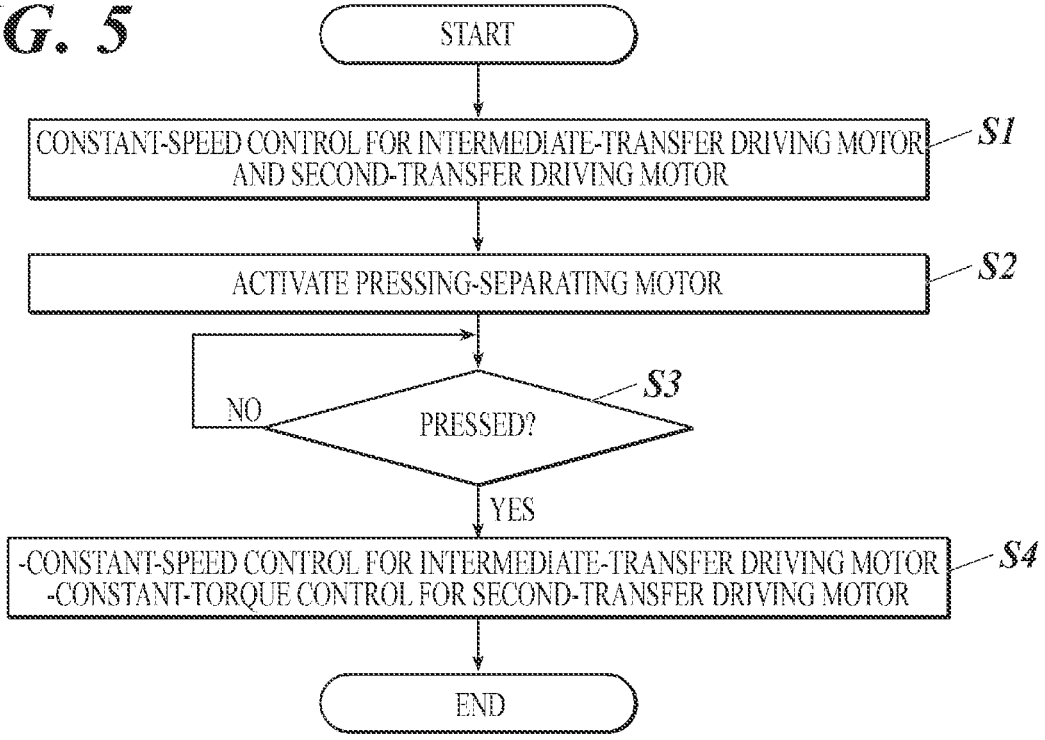
FIG. 5 is a flowchart of procedure of a controller controlling the intermediate transfer belt and the second transfer belt.

Next, the procedure of controlling the intermediate transfer belt 174 and the second transfer belt 63 by the controller 10 is described with reference to a flowchart in FIG. 5.

The controller 10 performs the constant-speed control in a state where the second transfer belt 63 is separate from the intermediate transfer belt 174. More specifically, the controller 10 controls the intermediate-transfer driving motor 41*a* and the second-transfer driving motor 61*a* using feedback such that the intermediate transfer belt 174 and the second transfer belt 63 rotate at their respective constant speeds, as described above (Step S1).

The controller 10 rotates the intermediate-transfer driving motor 41*a* on the basis of information on PWM signals corresponding to the target speed of the intermediate transfer belt 174. The information is stored in the storage 11 or set beforehand. The controller 10 also rotates the second-transfer driving motor 61*a* on the basis of information on PWM signals corresponding to the target speed of the second transfer belt 63. The information is stored in the storage 11 or set beforehand.

While performing the constant-speed control of the second-transfer driving motor 61*a*, the controller 10 detects the driving torque of the second-transfer driving motor 61*a* on the basis of the PWM signals. The controller 10 calculates an average of the detected driving torque and determines the average as the constant-speed driving torque. The method of determining the constant-speed driving torque is not specifically limited to a particular method in one or more embodiments of the present invention. The constant-speed driving torque may be a median of the detected driving torque or may be determined according to any other appropriate method.

The controller 10 activates the pressing-separating motor 65*a* to press the second transfer belt 63 against the intermediate transfer belt 174 (Step S2).

After pressing the second transfer belt 63 against the intermediate transfer belt 174 (Step S3: YES), the controller 10 performs the constant-torque control of the second-transfer driving motor 61*a* on the basis of the detected constant-speed driving torque, while continuing the constant-speed control of the intermediate-transfer driving motor 41*a* (Step S4).

When separating the second transfer belt 63 from the intermediate transfer belt 174, the controller 10 switches from the constant-torque control to the constant-speed control for the second-transfer driving motor 61*a*, although not shown in the figures.

Switching from the separated state to the pressed state can be done when, for example, image formation starts. Switching from the pressed state to the separated state can be done when a job and a reserved job are finished. Accordingly, (i) detection of the constant-speed driving torque of the second-transfer driving motor 61*a* and (ii) constant-torque control of the second-transfer driving motor 61*a* according to the constant-speed driving torque can be performed every cycle of finishing and starting a series of job. This allows the controller 10 to adjust torque values and perform the constant-torque control with appropriate torque values. For example, when load torque on the second-transfer driving motor 61*a* changes owing to abrasion of the cleaning blade 64*a* of the second-transfer cleaning unit 64, the controller 10 adjusts torque values according to the change in the load torque.

In the above description, detecting the constant-speed driving torque of the second-transfer driving motor 61*a* and performing the constant-torque control of the second-transfer driving motor 61*a* with the constant-speed driving torque are performed every cycle of finishing and starting a series of jobs. However, load torque may change when a series of jobs continues for a long time (e.g., over 10 hours). In the case, the controller 10 may: temporarily separate the second transfer belt 63 from the intermediate transfer belt 174 at an interval between jobs, for example; perform constant-speed control of the second-transfer driving motor 61*a*, which drives the second transfer belt 63, to detect the constant-speed driving torque; press again the second transfer belt 63 against the intermediate transfer belt 174; and perform constant-torque control of the second-transfer driving motor 61*a* with adjusted torque. Thus, when continuously performing jobs, the controller 10 can appropriately control the second transfer belt 63 according to changes in load torque.

The intermediate-transfer driving roller 41 and the second-transfer driving roller 61 shown in FIG. 3A are made to tolerances in their external forms. When the external form of the intermediate-transfer driving roller 41 is 0.1% bigger, the surface speed of the intermediate transfer belt 174 increases by 0.1% under the condition that the intermediate-transfer driving motor 41*a*, which is the driving force of the intermediate-transfer driving roller 41, rotates at a constant rotation speed (rotation rate). Similarly, when the external form of the second-transfer driving roller 61 is 0.1% bigger, the surface speed of the second transfer belt 63 increases by 0.1% under the condition that the second-transfer driving motor 61*a*, which is the driving force of the second-transfer driving roller 61, rotates at a constant rotation speed. The external-form tolerances of these rollers are amounts of variation in the rollers. The external form of the roller may change when parts of the roller is replaced, or the rollers in different image forming apparatuses may have different external forms.

In pressing the second transfer belt 63 against the intermediate transfer belt 174 as shown in FIG. 3B, difference in surface speeds between the second transfer belt 63 and the intermediate transfer belt 174 needs to be reduced as much as possible. The external-form tolerances as described above, however, may result in difference in surface speeds between the second transfer belt 63 and the intermediate transfer belt 174, and accordingly result in difference in driving forces between the second transfer belt 63 and the intermediate transfer belt 174. The difference in driving forces causes a shear in transferring images onto sheets, which decreases product quality.

Figure 6:
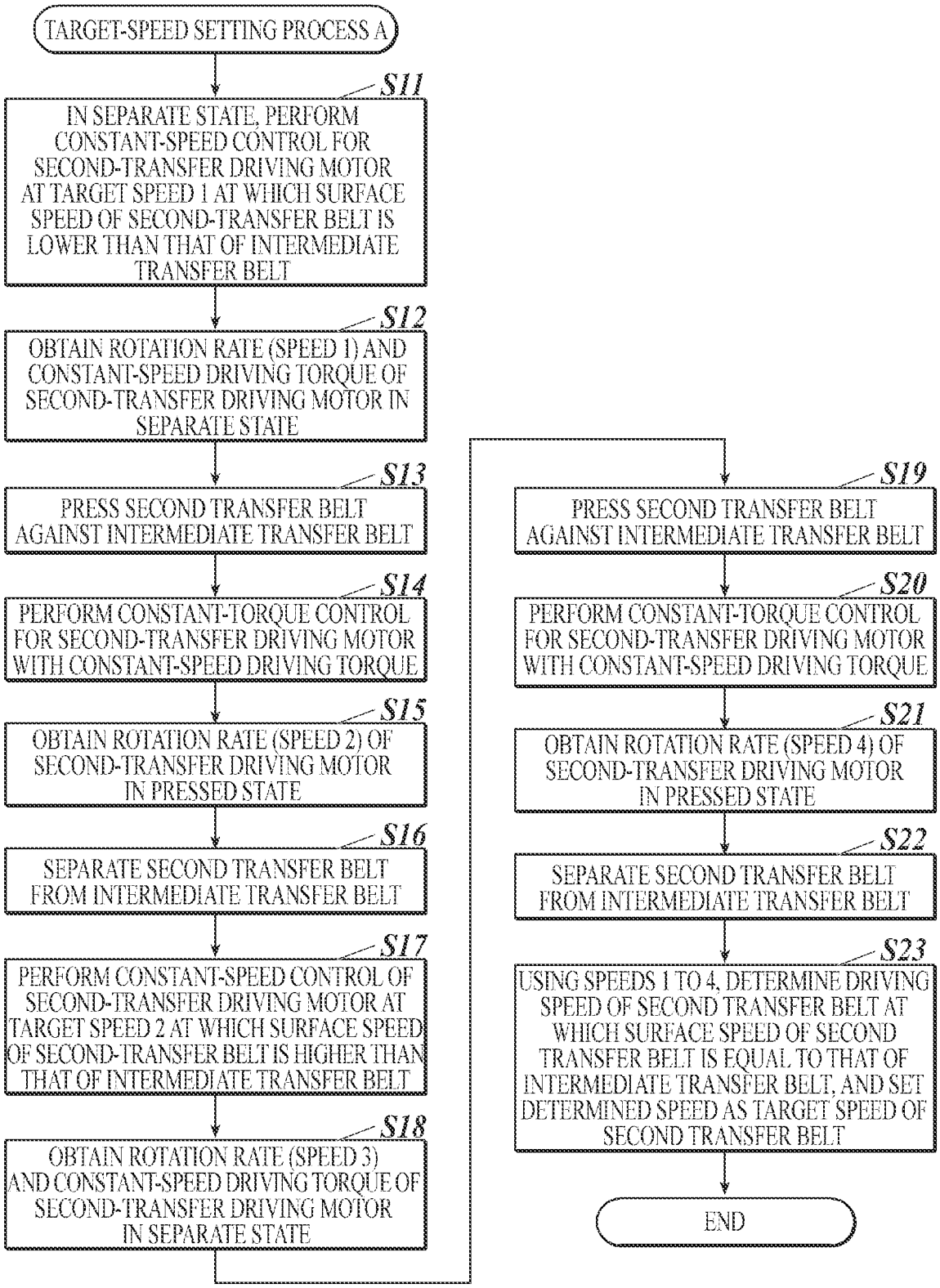
FIG. 6 is a flowchart of a target speed-setting process A.

In this embodiment, the controller 10 performs a target speed-setting process A shown in FIG. 6 to determine the target speed of the second transfer belt 63. The target speed is the driving speed of the second transfer belt 63 at which the second transfer belt 63 has the same surface speed as the surface speed of the intermediate transfer belt 174. The controller 10 performs the target speed-setting process A when, for example, the image forming apparatus 1 is shipped or when parts of the image forming apparatus 1 that affect the surface speeds of the intermediate transfer belt 174 and the second transfer belt 63 are replaced. Such parts include the intermediate-transfer driving roller 41, the second-transfer driving roller 61, the intermediate transfer belt 174, the second transfer belt 63, and the second transfer roller 176.

In the target speed-setting process A, in a state where the second transfer belt 63 is separate from the intermediate transfer belt 174, the controller 10 performs constant-speed control of the second transfer belt 63 by driving the second-transfer driving motor 61*a* at a target speed 1 (corresponding to first speed) (Step S1). At the target speed 1, the surface speed of the second transfer belt 63 is lower than the surface speed of the intermediate transfer belt 174.

The controller 10 obtains speed information of the second transfer belt 63 in the separated state. As the speed information of the second transfer belt 63, the controller 10 obtains the rotation rate of the second-transfer driving motor 61*a* during the constant-speed control in the separated state (referred to as speed 1). The rotation rate of the second-transfer driving motor 61*a* is, for example, an average of numbers of rotation per unit time detected during the constant-speed control. The controller 10 also obtains the constant-speed driving torque of the second-transfer driving motor 61*a* during the constant-speed control (Step S12).

The controller 10 presses the second transfer belt 63 against the intermediate transfer belt 174 using the pressing-separating mechanism 65 (Step S13) and, according to the constant-speed driving torque obtained in Step S12, performs constant-torque control of the second-transfer driving motor 61*a* (Step S14). The controller 10 then obtains speed information of the second transfer belt 63 in the pressed state (Step S15). As the speed information of the second transfer belt 63, the controller 10 obtains the rotation rate of the second-transfer driving motor 61*a* in the pressed state during the constant-torque control (referred to as speed 2). The rotation rate of the second-transfer driving motor 61*a* is, for example, an average of numbers of rotation per unit time detected during the constant-torque control.

Figure 7A:
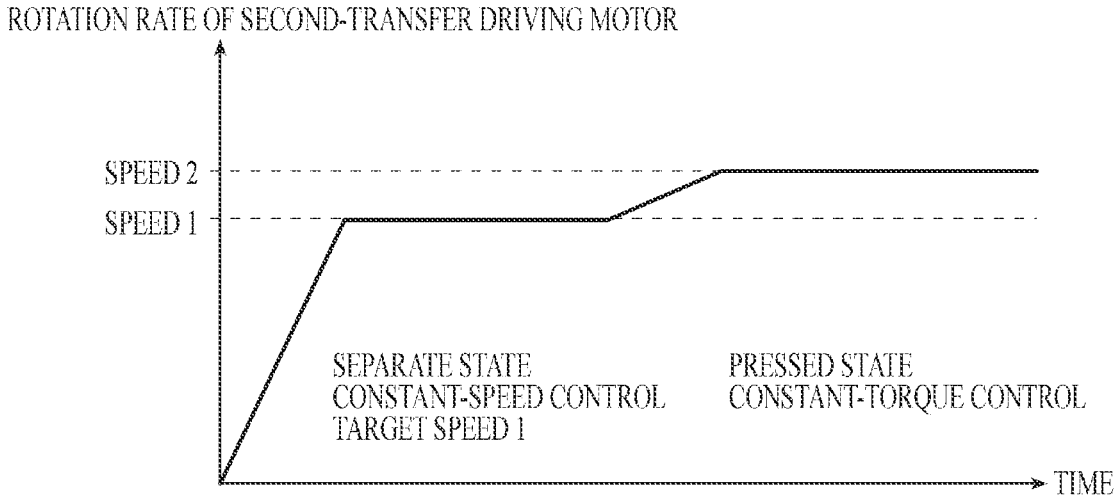
FIG. 7A is a graph showing chronological changes of the rotation rate of a second-transfer driving motor in Steps S11 to S15 in FIG. 6.

FIG. 7A shows a graph of chronological changes of the rotation rate of the second-transfer driving motor 61*a* in Steps S11 to S15. At the target speed 1 under the constant-speed control, the surface speed of the second transfer belt 63 is lower than the surface speed of the intermediate transfer belt 174. When the second transfer belt 63 is pressed against the intermediate transfer belt 174, the surface speed of the second transfer belt 63 increases according to the surface speed of the intermediate transfer belt 174. As a result, the rotation speed of the second-transfer driving motor 61*a* increases. In other words, the rotation rate of the second-transfer driving motor 61*a* increases.

The controller 10 then separates the second transfer belt 63 from the intermediate transfer belt 174 by using the pressing-separating mechanism 65 (Step S16) and performs constant-speed control of the second transfer belt 63 by driving the second-transfer driving motor 61*a* at a target speed 2 (corresponding to first speed) (Step S17). At the target speed 2, the surface speed of the second transfer belt 63 is higher than the surface speed of the intermediate transfer belt 174.

The controller 10 obtains speed information of the second transfer belt 63 in the separated state. As the speed information of the second transfer belt 63, the controller 10 obtains the rotation rate of the second-transfer driving motor 61*a* during the constant-speed control in the separated state (referred to as speed 3). The rotation rate of the second-transfer driving motor 61*a* is, for example, an average of numbers of rotation per unit time detected during the constant-speed control. The controller 10 also obtains the constant-speed driving torque of the second-transfer driving motor 61*a* under the constant-speed control (Step S18).

The controller 10 presses the second transfer belt 63 against the intermediate transfer belt 174 using the pressing-separating mechanism 65 (Step S19) and, according to the constant-speed driving torque obtained in Step S18, performs constant-torque control of the second-transfer driving motor 61*a* (Step S20). The controller 10 then obtains the rotation rate of the second transfer belt 63 under the constant-torque control (Step S21). As the speed information of the second transfer belt 63, the controller 10 obtains the rotation rate of the second-transfer driving motor 61*a* during the constant-torque control in the pressed state (referred to as speed 4). The rotation rate of the second-transfer driving motor 61*a* is, for example, an average of numbers of rotation per unit time detected during the constant-torque control.

Figure 7B:
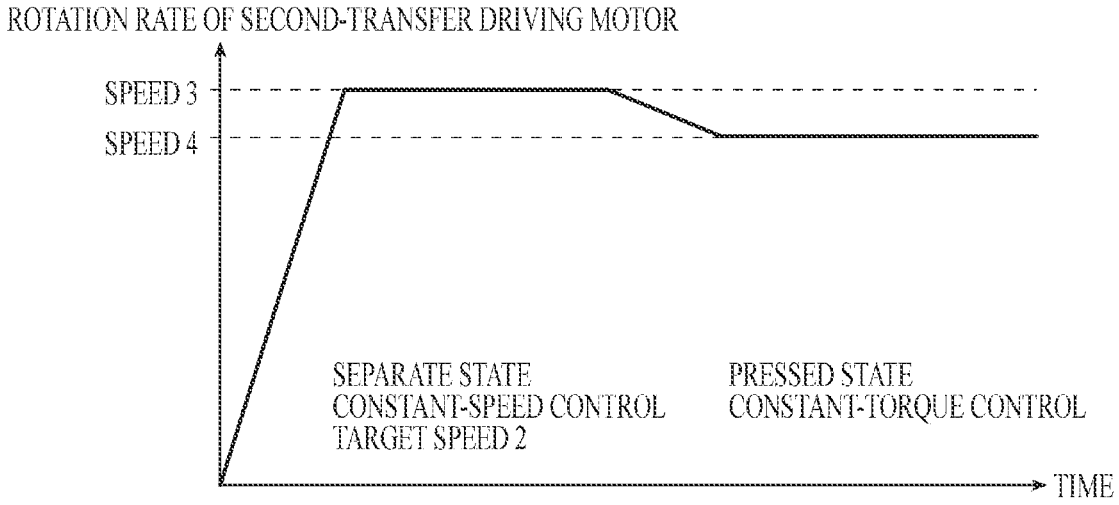
FIG. 7B is a graph showing chronological changes of the rotation rate of the second-transfer driving motor in Steps S17 to S21 in FIG. 6.

FIG. 7B shows a graph of chronological changes of the rotation rate of the second-transfer driving motor 61*a* in Steps S17 to S21. At the target speed 2 in the constant-speed control, the surface speed of the second transfer belt 63 is higher than the surface speed of the intermediate transfer belt 174. When the second transfer belt 63 is pressed against the intermediate transfer belt 174, the surface speed of the second transfer belt 63 decreases according to the surface speed of the intermediate transfer belt 174. As a result, the rotation speed of the second-transfer driving motor 61*a* decreases. In other words, the rotation rate of the second-transfer driving motor 61*a* decreases.

On the basis of the obtained speeds 1 to 4, the controller 10 determines the driving speed of the second transfer belt 63 (rotation rate of the second-transfer driving motor 61*a*) at which the surface speed of the second transfer belt 63 is the same as the surface speed of the intermediate transfer belt 174. The controller 10 sets/stores in the storage 11 information on PWM signals corresponding to the determined driving speed as information for setting the target speed of the second transfer belt 63 under the constant-speed control (Step S23). The controller 10 then ends the target speed-setting process A.

In Step S23, the controller 10 calculates the target speed of the second transfer belt 63 using the following formula 1 for linear interpolation.

$$\text{Target speed}=\text{Speed 2}-|\text{Speed 2}-\text{Speed 1}|\times(\text{Speed 2}-\text{Speed 4})/((\text{Speed 4}-\text{Speed 3})-(\text{Speed 2}-\text{Speed 1})) \qquad \text{Formula 1}$$

Figure 7C:
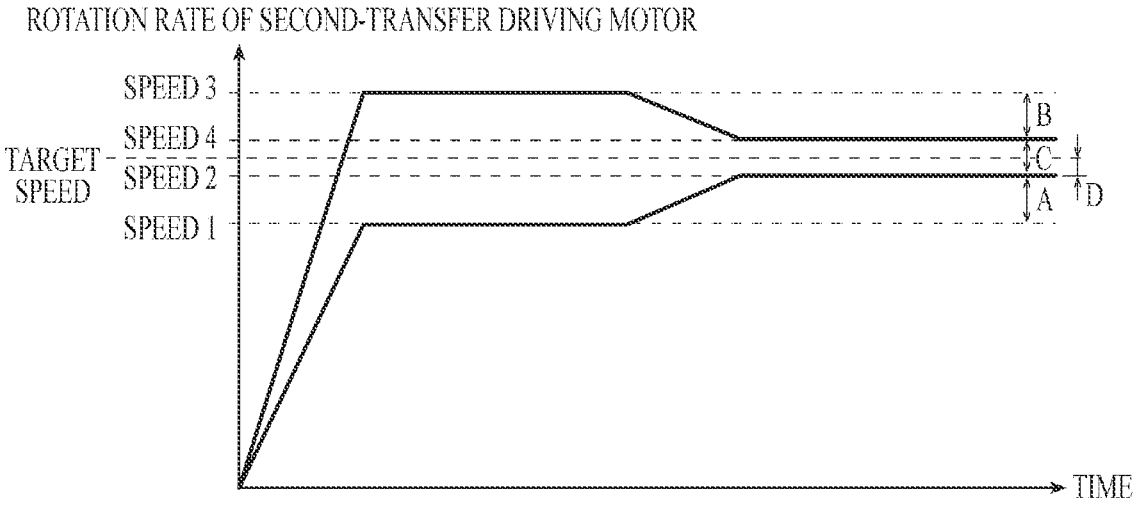
FIG. 7C shows the layered graphs of FIG. 7A and FIG. 7B.

FIG. 7C shows the layered graphs in FIG. 7A and FIG. 7B. Assuming that (Speed 2−Speed 1) is A, (Speed 3−speed 4) is B, and (Speed 4−Speed 2) is C in the formula 1, the target speed is the total of the speed 2 and $D=C\times A/(A+B)$.

According to the target speed-setting process A, difference in surface speeds of the intermediate transfer belt 174 and the second transfer belt 63 pressed against each other can be reduced. This can restrain decrease in product quality of the image forming apparatus 1 due to, for example, a shear in transferred toner images.

In the target speed-setting process A, the controller 10 obtains speed changes of the second transfer belt 63 only twice, namely (i) when separating the second transfer belt 63 from the intermediate transfer belt 174 and (ii) when pressing the second transfer belt 63 against the intermediate transfer belt 174. Thus, the controller 10 can calculate an accurate target speed by obtaining speed information of the second transfer belt 63 only a few times. Further, the controller 10 calculates the target speed on the basis of both (i) the speed of the second transfer belt 63 higher than the speed of the intermediate transfer belt 174 and (ii) the speed of the second transfer belt 63 lower than the speed of the intermediate transfer belt 174. The controller 10 thus can calculate the target speed by taking into account slips that occur when the intermediate transfer belt 174 and the second transfer belt 63 are pressed against each other.

Second Embodiment

Next, a second embodiment of the present invention is described.

Figure 8:
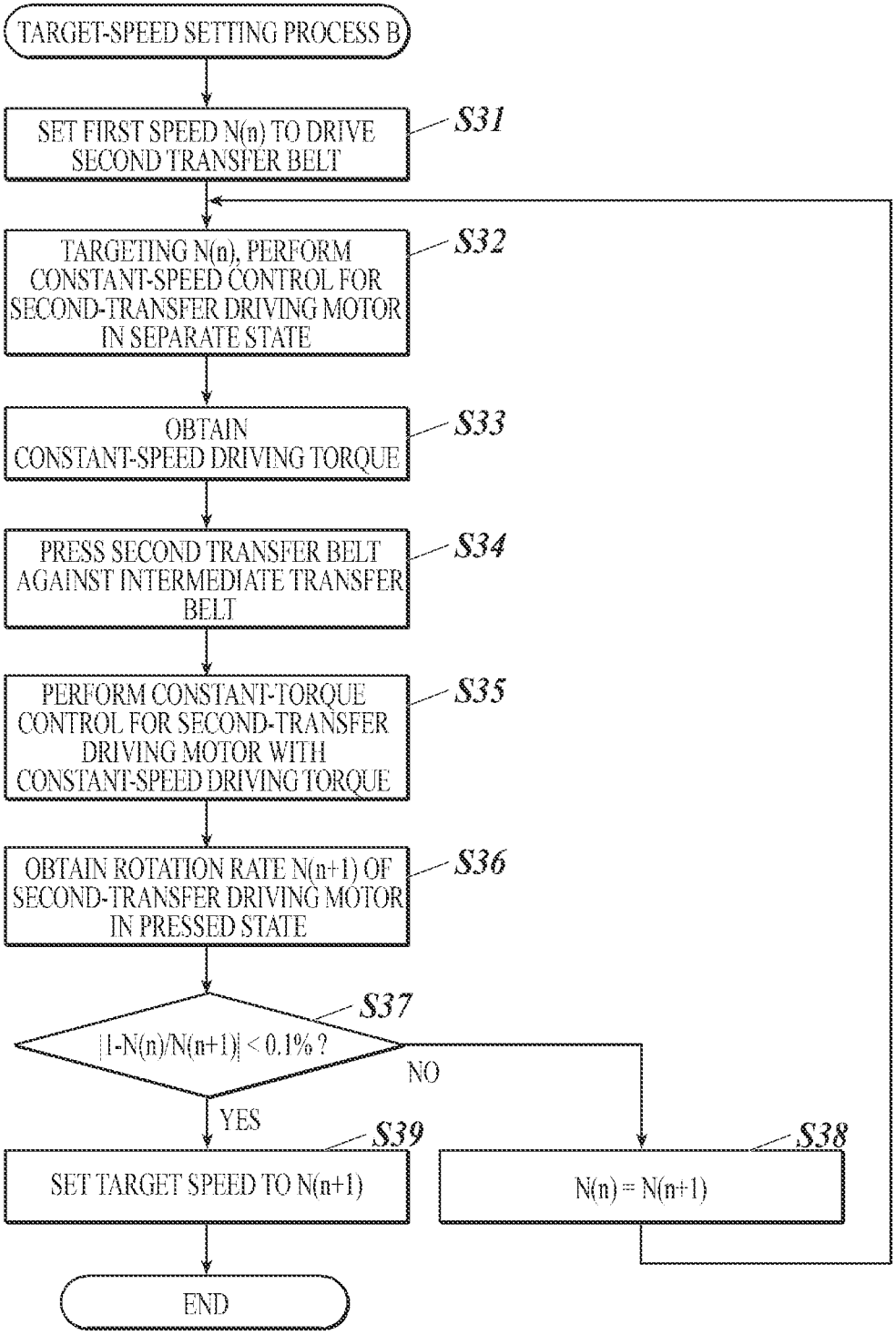
FIG. 8 shows a flowchart of a target speed-setting process B.

The configuration of the image forming apparatus 1 and control procedure of the intermediate transfer belt 174 and the second transfer belt 63 in the second embodiment are the same as in the first embodiment. The process for determining the target speed of the second transfer belt 63 in the second embodiment is different from that in the first embodiment. In the second embodiment, the controller 10 performs a target speed-setting process B shown in FIG. 8 when the image forming apparatus 1 is shipped or when parts of the image forming apparatus 1 are replaced. Hereinafter, the target speed-setting process B is described referring to FIG. 8.

In the target speed-setting process B, the controller 10 sets a first speed N(n) that is the driving speed of the second transfer belt 63 (Step S31). The first speed N(n) is the number of rotation of the second-transfer driving motor 61*a* per unit time. N(n) may be set to any appropriate speed.

In the separated state where the second transfer belt 63 is separate from the intermediate transfer belt 174, the controller 10 sets N(n) as a target value and performs constant-speed control of the second-transfer driving motor 61*a* (Step S32).

The controller 10 obtains the constant-speed driving torque of the second-transfer driving motor 61*a* under the constant-speed control (Step S33).

The controller 10 presses the second transfer belt 63 against the intermediate transfer belt 174 by using the pressing-separating mechanism 65 (Step S34) and, according to the constant-speed driving torque obtained in Step S33, performs constant-torque control of the second-transfer driving motor 61*a* (Step S35). The controller 10 obtains, as speed information of the second transfer belt 63 in the pressed state, the rotation rate of the second-transfer driving motor 61*a* during the constant-torque control, and sets the obtained speed information as N(n+1) (Step S36). The rotation rate of the second-transfer driving motor 61*a* is, for example, an average of numbers of rotation per unit time detected during the constant-torque control.

The controller 10 determines whether or not the difference between speeds N(n) and N(n+1) ($|1-N(n)/N(n+1)|$) is less than a predetermined threshold (Step S37). In this embodiment, the threshold is 0.1.

When determining that the difference between speeds N(n) and N(n+1) is not less than the predetermined threshold (Step S37: NO), the controller 10 sets N(n+1) as N(n) (Step S38). The controller 10 then returns to Step S32 and repeats the process from Step S32 to Step S37.

Repeating Steps from S32 to S37 allows the surface speed of the second transfer belt 63 to be substantially equal to the surface speed of the intermediate transfer belt 174.

When determining that the difference between speeds N(n) and N(n+1) is less than the predetermined threshold (Step S37: YES), the controller 10 sets/stores in the storage 11 information on PWM signals corresponding to N(n+1) as information for setting the target speed of the second transfer belt 63 under constant-speed control (Step S39). The controller 11 then ends the target speed-setting process B.

As described above, the target speed-setting process B can reduce difference in surface speeds between the intermediate transfer belt 174 and the second transfer belt 63 pressed against each other. This can restrain deterioration of product quality of the image forming apparatus 1 due to a shear in transferred toner images, for example.

According to the target speed-setting process B, change in speed during the process is less likely to affect the accuracy of calculation of the target speed.

Speed changes due to load change or noises during the process may decrease reliability of detected speeds. In the first embodiment, such speed changes may cause large errors as a result of linear interpolation calculation. In the second embodiment, on the other hand, the speed changes are less likely to result in large errors.

The embodiments of the present invention described above are some examples of an image forming apparatus and do not limit the present invention.

In the first and second embodiments, the first rotatable member is the intermediate transfer belt 174, and the second rotatable member is the second transfer belt 63. The present invention is also applicable to a case where the first and second rotatable members to be pressed against each other are other than the intermediate transfer belt 174 and the second transfer belt 63 in the image forming apparatus and where the target speed of the second rotatable member is set such that the surface speed of the second rotatable member is equal to that of the first rotatable member. For example, the present invention is applicable to a case where the first rotatable member is the photoconductor 172, and the second rotatable member is the intermediate transfer belt 174, and the surface speeds of the intermediate transfer belt 174 is to be made equal to that of the photoconductor 172. The present invention is also applicable to a case where the first rotatable member is the upper fixing member 181, and the second rotatable member is the lower fixing member 182, and the surface speed of the lower fixing member 182 is to be made equal to that of the upper fixing member 181. The present invention is also applicable to an image forming apparatus that does not perform intermediate transfer. In the case, the first rotatable member is the photoconductor, and the second rotatable member is the transfer member (e.g., transfer roller) to be pressed against the photoconductor, and the surface speed of the transfer member is to be made equal to that of the photoconductor. The present invention is also applicable to an image forming apparatus that directly presses a second transfer roller against an intermediate transfer belt without a second transfer belt inbetween. In the case, the first rotatable member is the intermediate transfer belt, and the second rotatable member is the second transfer roller, and the surface speed of the second transfer roller is to be made equal to that of the intermediate transfer belt.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

What is claimed is:

1. An image forming apparatus comprising:

a first rotatable member;

a second rotatable member that presses against the first rotatable member in a pressed state and separates from the first rotatable member in a separated state; and a hardware processor that:

obtains first information on a first speed of the second rotatable member in the separated state and second information on a second speed of the second rotatable member in the pressed state, obtains a change in speed of the second rotatable member between the first and second speeds based on the first and second information, based on the change in speed, determines a speed of the second rotatable member at which the second rotatable member has a surface speed equal to a surface speed of the first rotatable member, and sets the determined speed as a target speed of the second rotatable member.

2. The image forming apparatus according to claim 1, wherein the hardware processor:

controls the second rotatable member in the separated state to rotate at a constant speed, and controls the second rotatable member in the pressed state to rotate with a constant torque based on a constant-speed driving torque detected in controlling the second rotatable member to rotate at the constant speed.

3. The image forming apparatus according to claim 1, wherein the hardware processor:

rotates the first rotatable member at a constant speed, repeatedly executes, multiple times with different initial speeds, an operation of: rotating the second rotatable member in the separated state at an initial speed; pressing the second rotatable member against the first rotatable member; and obtaining the speed of the second rotatable member in the pressed state, and based on the initial speeds and the obtained speeds, sets the target speed of the second rotatable member.

4. The image forming apparatus according to claim 3, wherein the hardware processor:

rotates the second rotatable member at the initial speeds including a higher speed than the speed of the first rotatable member and a lower speed than the speed of the first rotatable member, obtains the initial speeds of the second rotatable member in the separated state and the corresponding speeds of the second rotatable member in the pressed state, and based on the initial speeds and the obtained speeds, sets the target speed of the second rotatable member.

5. The image forming apparatus according to claim 3, wherein in repeatedly executing the operation, the hardware processor sets the obtained speed of the second rotatable member in the pressed state to an initial speed in a next operation.

6. The image forming apparatus according to claim 5, wherein the hardware processor repeats the operation until a difference between the initial speed in the separated state and the corresponding obtained speed of the second rotatable member in the pressed state is less than a predetermined threshold.

7. The image forming apparatus according to claim 1, wherein the first rotatable member is a photoconductor, and the second rotatable member is at least one of a transfer belt and a transfer roller.

8. The image forming apparatus according to claim 1, wherein the first rotatable member is a photoconductor, and the second rotatable member is an intermediate transfer belt.

9. The image forming apparatus according to claim 1, wherein the first rotatable member is an intermediate transfer belt, and the second rotatable member is a second transfer roller.

10. The image forming apparatus according to claim 1, wherein the first rotatable member is an upper fixing roller, and the second rotatable member is a lower fixing roller.

* * * * *